US010137470B2

(12) United States Patent
Jegust et al.

(10) Patent No.: US 10,137,470 B2
(45) Date of Patent: Nov. 27, 2018

(54) SYSTEM FOR PAINTING OBJECTS

(71) Applicant: EISENMANN SE, Boeblingen (DE)

(72) Inventors: Benjamin Jegust, Moetzingen (DE); David Berner, Altdorf (DE); Andreas Groll, Wildberg (DE); Alexander Bosch, Notzingen (DE)

(73) Assignee: EISENMANN SE, Boeblingen (DE)

( * ) Notice: Subject to any disclaimer, the term of this patent is extended or adjusted under 35 U.S.C. 154(b) by 0 days.

(21) Appl. No.: 15/315,909

(22) PCT Filed: May 23, 2015

(86) PCT No.: PCT/EP2015/001065
§ 371 (c)(1),
(2) Date: Dec. 2, 2016

(87) PCT Pub. No.: WO2015/185190
PCT Pub. Date: Dec. 10, 2015

(65) Prior Publication Data

US 2017/0113240 A1 Apr. 27, 2017

(30) Foreign Application Priority Data

Jun. 3, 2014 (DE) ..... 10 2014 008 280

(51) Int. Cl.
*B05B 16/00* (2018.01)
*B05B 12/14* (2006.01)
(Continued)

(52) U.S. Cl.
CPC ..... *B05B 16/40* (2018.02); *B05B 9/035* (2013.01); *B05B 12/1472* (2013.01);
(Continued)

(58) Field of Classification Search
USPC ..... 118/300, 323, 326, 309, 50, 719
See application file for complete search history.

(56) References Cited

U.S. PATENT DOCUMENTS 4,928,880 A 5/1990 Pruss et al.
8,453,597 B2 6/2013 Ansorge et al.
(Continued)

FOREIGN PATENT DOCUMENTS

DE 10 2006 032 804 A1 1/2008
DE 10 2010 047 448 A1 4/2012
(Continued)

*Primary Examiner* — Yewebdar T Tadesse
(74) *Attorney, Agent, or Firm* — Schroeder Intellectual Property Law Group, LLC

(57) ABSTRACT

A system for painting objects having a plurality of ring lines extending along a painting booth, each ring line conducting an operating medium required for operating an application device provided in the painting booth. The ring lines are divided into at least two regions. A connection device connects at least some of the ring lines to the application device and has a terminal module. The terminal module includes at least as many ring line sections as there are ring lines. The ring line sections have terminals at the ends to connect to the ring line regions. A branch line branches off from each of the ring line sections, the branch line leading to a terminal device. The terminal device has an inner flow path via which at least some of the branch lines can be connected to an outlet terminal. At least one tube or a line connects the outlet terminal to the application device.

13 Claims, 3 Drawing Sheets

(51) Int. Cl.

| | |
|---|---|
| ***B05B 16/40*** | (2018.01) |
| ***B05B 16/60*** | (2018.01) |
| ***B05B 14/40*** | (2018.01) |
| ***B05B 14/46*** | (2018.01) |
| ***B05C 15/00*** | (2006.01) |
| ***B05B 9/03*** | (2006.01) |
| *B05B 5/16* | (2006.01) |
| *B05B 13/04* | (2006.01) |

(52) U.S. Cl.
CPC ..... *B05B 12/1481* (2013.01); *B05B 14/40* (2018.02); *B05B 14/46* (2018.02); *B05B 16/00* (2018.02); *B05B 16/60* (2018.02); *B05C 15/00* (2013.01); *B05B 5/16* (2013.01); *B05B 12/14* (2013.01); *B05B 13/0431* (2013.01)

(56) References Cited

U.S. PATENT DOCUMENTS

| | | | | |
|---|---|---|---|---|
| 2005/0173018 | A1* | 8/2005 | Herre | B05B 5/1616 141/91 |
| 2006/0066064 | A1* | 3/2006 | Hardy | B25H 3/06 280/79.2 |
| 2009/0145976 | A1 | 6/2009 | Takeguchi et al. | |
| 2010/0047465 | A1 | 2/2010 | Ansorge et al. | |
| 2010/0061179 | A1 | 3/2010 | Lendzion et al. | |
| 2011/0014371 | A1* | 1/2011 | Herre | B05B 12/1418 427/236 |

FOREIGN PATENT DOCUMENTS

| | | | |
|---|---|---|---|
| EP | 0 292 354 | A1 | 11/1988 |
| FR | 2 618 087 | A1 | 1/1989 |

* cited by examiner

SYSTEM FOR PAINTING OBJECTS

RELATED APPLICATIONS

This application is a national phase of International Patent Application No. PCT/EP2015/001065, filed May 23, 2015, which claims the filing benefit of German Patent Application No. 10 2014 008 280.6, filed Jun. 3, 2014, the contents of both of which are incorporated herein by reference.

FIELD OF THE INVENTION

The invention relates to a system for painting objects, in particular vehicle bodies, comprising a) a painting booth;

b) at least one application device arranged in the painting booth, from which paint can be discharged onto the objects;

c) a plurality of ring lines, which extend along the painting booth and each carry an operating medium needed for the operation of the application device, in particular a paint of a specific color or a purging liquid or air;

d) at least one connecting device, via which at least some of the ring lines can be connected to the application device as required.

BACKGROUND OF THE INVENTION

Painting systems of this type have a very wide spread, which does not need documented proof. In practice, for which documented proof is missing, the connection of the ring lines to the application device or, what is more frequent, to a plurality of application devices is made in that, when setting up the painting system, branch lines are fitted to the ring lines on site by the mounting personnel and are then connected in a suitable way to the application device or devices. The areas around the branches, at which leaks can possibly occur, must be surrounded by hand with a suitable housing which, for safety reasons, must be gas-tight and liquid-tight. This work serving to connect the ring lines to the application devices and to be carried out by hand is comparatively labor-intensive and inclined to faults. The testing of the tightness of all the connections on-site is complicated. If an existing system of this type is to be converted for a new application and, in the process, new connections to the ring lines have to be produced; this is likewise very labor-intensive and fraught with errors.

SUMMARY OF THE INVENTION

It is an object of the present invention to configure a system of the type mentioned at the beginning in such a way that the connection between the ring lines and the application devices can be produced more quickly and more reliably.

According to the invention, this object may be achieved in that e) each ring line is subdivided into at least two ring line regions;

f) the connecting device has at least one factory-prefabricated terminal module, which in turn comprises:

fa) at least as many ring line sections as there are ring lines, which have terminals at their ends to connect to the ring line regions;

fb) for each ring line section, a branch line branching off from the latter;

fc) a terminal device, to which the branch lines lead and via which at least some of the branch lines can be connected to an outlet terminal;

g) at least one hose or a line connects the outlet terminal of the terminal module directly or indirectly to the application device.

By means of the terminal module according to the invention, all the complicated work which tends to faults and has to be checked is outsourced from the construction site in which the painting system is set up into the factory, where the work can be carried out under optimal conditions and the checking possibilities are very much better than on the construction site. This terminal module, after being fabricated and checked, is brought to the construction site and inserted between the ring line regions there, which completes the ring lines. Finally, the connecting hose which leads directly or indirectly to the application device is fixed to the outlet terminal. This work can be carried out very quickly and in general does not represent any actual source of faults.

Terminal modules according to the invention can be prefabricated in the factory in series, which likewise contributes to cost saving. They can if necessary also be kept in stock, so that in the event of a fault which arises in a terminal module that is in use, the entire terminal module can be replaced as quickly as possible.

It is particularly preferred if a terminal module is provided for each application device. The terminal modules can here be matched to the type of application device. Thus, for example, it is also possible to keep a special type of terminal module in stock for each type of application device.

The terminal device, which is provided within the terminal module, can contain at least one color changer of conventional design, with which one of the various ring lines which carry paint of different color can be connected to the application device.

Likewise, it is possible that the terminal device comprises at least one pigging station of known design, from which pigs can be loaded into the hose or the line which leads in the direction of the application device, in order in this way to clean said hose or line or else to deliver the respective operating medium.

The terminal module can in particular also comprise a gas-tight housing. Thus, an internal atmosphere that is separate from the external atmosphere can be maintained in the same, which may be advantageous, for example, in view of explosion protection. This gas-tight housing is also very much simpler to produce in the factory than on site on the construction site.

It is expedient here if the housing of the terminal module has a window, via which the interior of the terminal module can be inspected, so that leaks can be detected without difficulty by the operating personnel.

In most painting systems which are currently in use, at least one catwalk that can be entered by operating personnel is provided along the painting booth. The terminal module can now optionally be fitted on the catwalk or underneath the catwalk. In the latter case, it is recommended that the catwalk have a window above the terminal module, via which the terminal module can be observed.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention will be explained in more detail below by using the drawings, in which.

DETAILED DESCRIPTION OF THE PRESENT INVENTION

Figure 1:
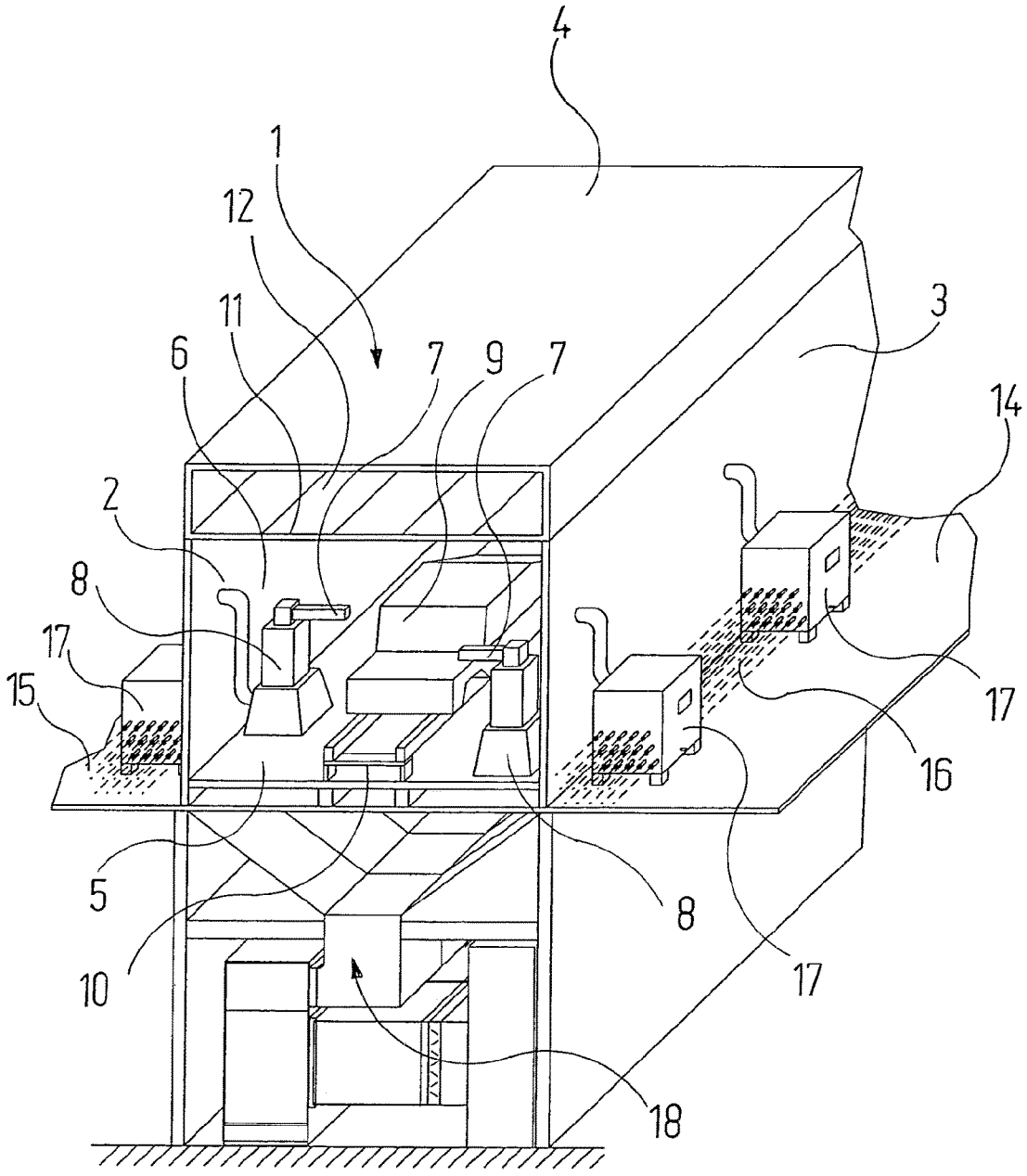
FIG. 1 shows a detail from a painting system, perspectively and in section.
Figures 2, 3, 4:
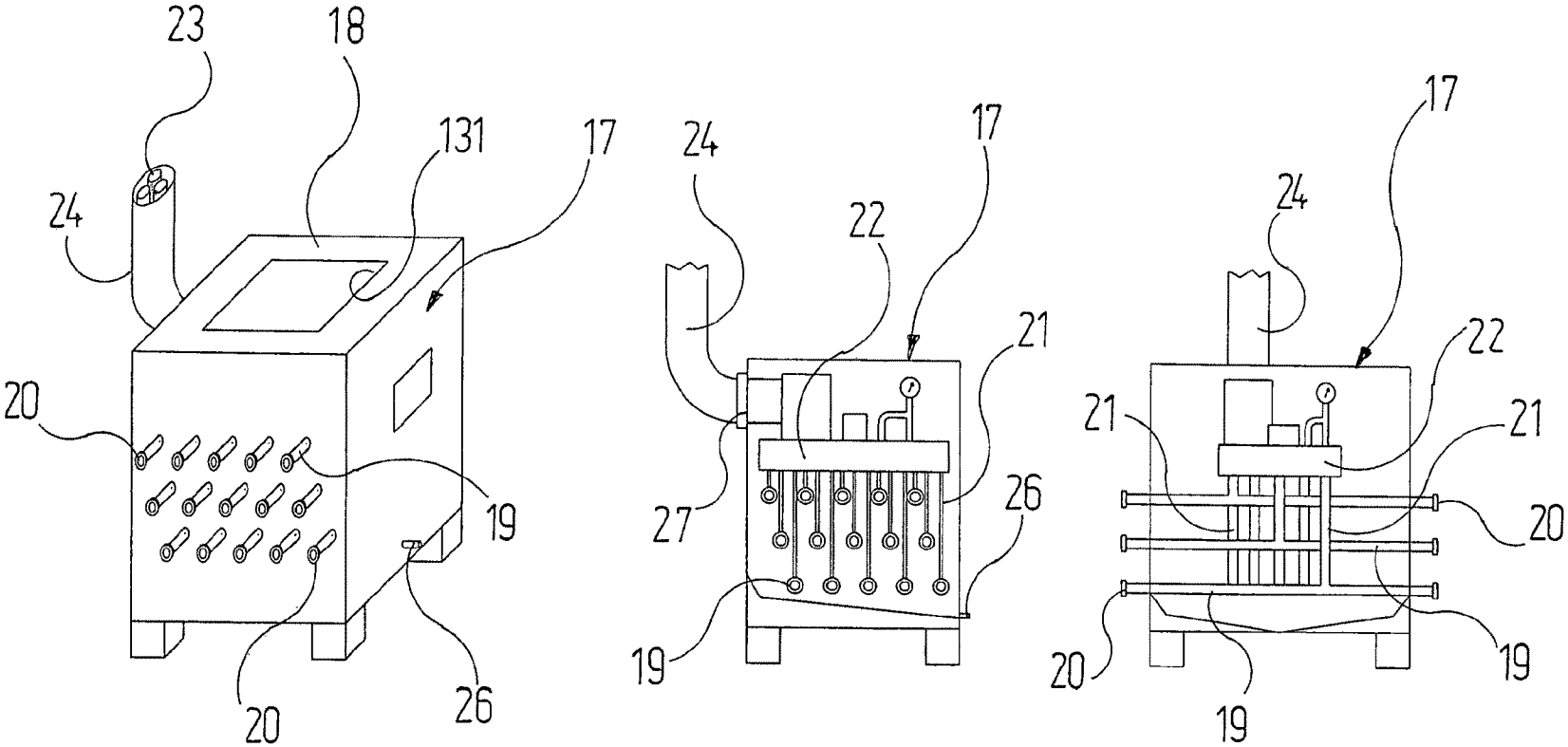
FIG. 2 shows, perspectively, a terminal module such as is used in the painting system of FIG. 1.
FIG. 3 shows a section through the terminal module from FIG. 2 in the direction at right angles to the pipelines extending through the same.
FIG. 4 shows a section through the terminal module from FIG. 2 in the direction parallel to the pipelines extending through the same.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Reference is firstly made to FIGS. 1 to 4. In FIG. 1, the designation 1 shows a painting booth, as it is known in its basic structure. It is part of a painting system in which various stations are connected upstream and downstream of the painting booth 1 but, in the present connection, are without interest. The painting booth 1 has two side walls 2, 3, two end walls, which cannot be seen in the drawing, a ceiling 4 and a floor 5, which together bound a tunnel-like painting chamber 6. With the aid of a transport system 10, illustrated schematically, vehicle bodies 9 to be painted are introduced into the painting chamber 6 via one of the end walls, in which there is a suitable airlock, and are painted in said chamber with the aid of application devices 7, which are guided by robots 8 under program control. After that, said vehicle bodies leave the painting booth 1 via a corresponding airlock in the other end wall and are fed to following stations.

In a manner which corresponds to the prior art, conditioned air flows through the painting chamber 6 from top to bottom, emerging from an air plenum 12 via a filter ceiling 11 and, on the way through the painting chamber 6, entrains overspray, i.e. colored material which does not adhere to the vehicle bodies 9 to be painted. The air thus loaded with overspray escapes through openings in the floor 5 of the painting booth 1 and then passes into a washing system 13, which is located underneath the actual painting booth 1 and in which the air is freed as far as possible of paint particles, so that, if necessary following appropriate reconditioning, it can be fed back wholely or partly into the air plenum 12.

On both sides of the side walls 2, 3 of the painting booth 1 there extend catwalks 14, 15, i.e. structures on which operating personnel can move. These catwalks 14, 15 can, for example, also be formed as gratings.

For the function of the application devices 7 and the robots 8, various operating media are needed. These operating media include in particular the colors which are to be sprayed as desired onto the vehicle bodies 9 by the application devices 7, but also purging liquid or air. In order to provide these operating media, a plurality of ring lines 16 is led along on the side walls 2, 3 of the painting booth 1. The majority of these ring lines 16 carry paint of different colors, which are fed as desired to the application devices 7 in the manner described below. At least one of these ring lines 16 carries purging medium, which is needed for cleaning the areas that are reached by the paint in the various feed lines and in the application devices 7, in particular during a color change. One of these ring lines 16 carries contaminated purging liquid away, and a further ring line 16 is used to supply compressed air, which is needed to operate the robot 8.

From the ring lines 16, the various operating media have to be fed to the individual robots 8 and the application devices 7 fitted in the latter. For this purpose, a terminal module 17 is provided for each robot 8, being arranged beside the side walls 2, 3 of the painting booth 1 and above the catwalks 14, 15 in the exemplary embodiment of FIG. 1. For the more detailed description of these terminal modules 17, reference is now made to FIGS. 2 and 4.

Each terminal module 17 comprises a gas-tight housing 18. Within the housing 18 there extend ring line sections 19, which each pierce an end wall of the housing 18 on opposite sides and, at their opposite ends, are provided with terminal screw fittings 20. The number of ring line sections 19 corresponds at least to the number of ring lines 16 but can also be greater than the number of the latter. The reason for this is that the terminal modules 17, which will be explained in more detail further below, can be standardized structural components which are suitable for different intended uses and can therefore also be used in painting systems which have a different number of ring lines 16.

Within the housing 18 of the corresponding terminal module 2, each ring line section 19 is connected to a branch line 21, which leads to a terminal device 22. From an outlet terminal 27 of this terminal device 22, which is arranged on the outside of the housing 18, a bundle of lines or hoses 23, which are collected together in an outer line or outer hose 24, lead through a side wall of the housing 18 to a robot 8. From the robot 8, the various operating media are then passed on in a known way to the application device 7.

In the simplest case, the terminal device 22 within the terminal module 17 is configured in such a way that each individual hose 23 is assigned to a ring line section 19 in a 1:1 assignment. The terminal device 22 can, however, also contain a color changer of known design. With the aid of the latter, it is possible to take care that a specific ring line section 19 carrying a specific painting color is connected to an individual hose 23. The number of individual hoses 23 in this case is lower than the number of ring line sections 19 within the housing 18. The terminal device 22 can also be configured as a pigging station, so that the individual hoses 23 can be moved through with the aid of pigs for cleaning or transport purposes. The associated second pigging station is located in the robot 8 in this case.

In the lower region of the housing 18, a collecting trough 25 is provided, being shaped and inclined in such a way that liquids collect therein in the event of the occurrence of leaks and flow down to a lowest point, at which an outlet 26 ensures extraction is possible.

The terminal module 17 described in this way is produced in the factory, that is to say not when constructing the painting system at the appropriate construction site. This means in particular that all the connecting welds which are required to produce the internal connections between the ring line sections 19, the branch lines 21 and the terminal device 22, and also the connecting welds which join the housing 18 together to form a gas-tight unit, can be carried out in the factory with good monitoring and under optimal conditions. In addition, a functional check, which includes a tightness check, can thus be performed in the factory. The prefabricated and checked terminal modules 17 are then brought to the construction site at which the painting booth 1 is erected and, with the aid of the terminal screw fittings 20, are inserted into the ring lines 16 at the appropriate points. In the process, the outer hose 24 with the individual hoses contained therein is also connected to the outlet terminal 27 of the terminal module 17.

The use of the prefabricated and pre-checked terminal modules 17 makes the construction of the painting system considerably easier. Leaks in the various lines carrying operating media and at the connecting points can be ruled out in this way to the greatest possible extent. The terminal modules 2 can be produced in standardized form in relatively large numbers. It is possible in this case to keep various types in stock, which are then used as needed. Even conversion of the painting booth 1, which is associated with changing the operating media used, can be effected simply as needed by replacing the appropriate terminal modules 17.

Figure 5:
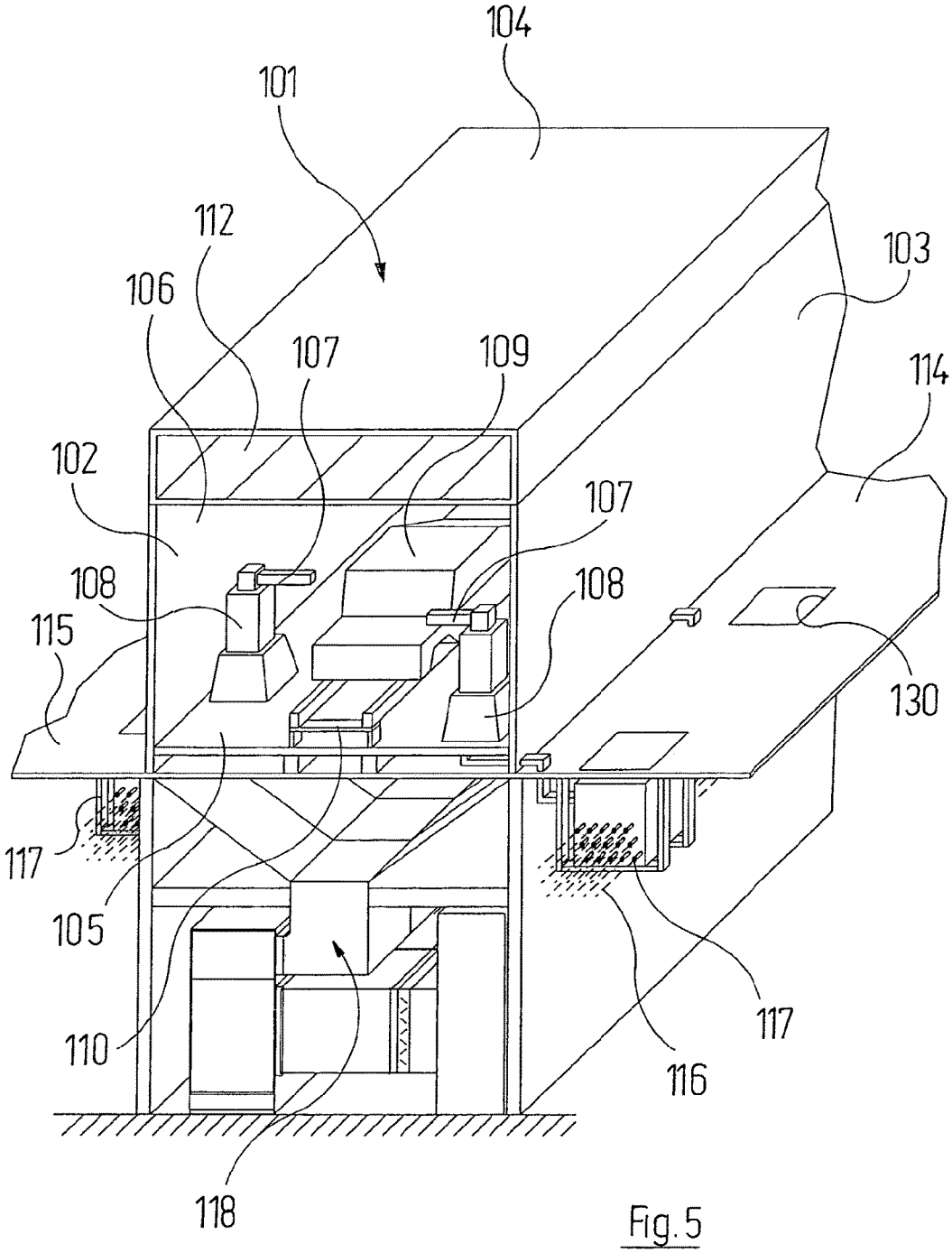
FIG. 5 shows a perspective section, similar to FIG. 1, through a second exemplary embodiment of a painting system.

The exemplary embodiment of a painting system which is shown in FIG. 5 corresponds to the greatest possible extent to the above-described exemplary embodiment of FIG. 1. Corresponding parts are therefore identified with the same designations plus 100. The single relevant difference consists in the fact that the various terminal modules 117 are not fitted on but underneath the lateral catwalks 114, 115. Through windows 130 in the catwalks 114, 115 and windows 131 in the upper side of the terminal modules 117, the operating personnel can obtain a view into the interior of the housings 118 of the terminal modules 117 and thus, if necessary, perform a tightness check visually.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

What is claimed is:

1. A system for painting comprising:

a) a painting booth;

b) at least one application device arranged in the painting booth, from which paint can be discharged onto objects;

c) a plurality of ring lines, which extend along the painting booth and each carry an operating medium needed for operation of the at least one application device;

d) at least one connecting device, via which at least some of the ring lines can be connected to the at least one application device as required;

wherein e) each ring line is subdivided into at least two ring line regions;

f) the at least one connecting device has at least one factory-prefabricated terminal module, the at least one factory-prefabricated terminal module being connected to the at least two ring line regions of each ring line, between each of the at least two ring line regions, to complete each ring line, the at least one factory-prefabricated terminal module comprising fa) at least as many ring line sections as there are ring lines, each ring line section having a terminal at each opposing end of the ring line section, wherein a first terminal of each ring line section connects to a first region of one ring line, and a second terminal of each ring line section connects to a second region of one ring line;

fb) for each ring line section, a branch line branching off from the latter;

fc) a terminal device, to which the branch lines lead and via which at least some of the branch lines can be connected to an outlet terminal;

g) at least one hose or a line connecting the outlet terminal of the at least one factory-prefabricated terminal module directly or indirectly to the application device.

2. The system as claimed in claim 1, wherein a terminal module is provided for each application device.

3. The system as claimed in claim 1, wherein the terminal device comprises at least one color changer.

4. The system as claimed in claim 1, wherein the terminal device comprises at least one pigging station.

5. The system as claimed in claim 1, wherein the at least one factory-prefabricated terminal module comprises a gas-tight housing.

6. The system as claimed in claim 5, wherein the gas-tight housing includes a collecting trough, the collecting trough being positioned below the branch lines and inclined towards one side of the collecting trough.

7. The system of claim 6, wherein the gas-tight housing comprises an outlet, the outlet being located in the housing proximate a lowest portion of the collecting trough to facilitate removal of liquids collected in the collecting trough from the housing.

8. The system as claimed in claim 5, wherein the gas-tight housing of the at least one factory-prefabricated terminal module has a viewing window.

9. The system as claimed in claim 1, in which at least one catwalk that can be entered by operating personnel is provided along the painting booth, wherein the at least one factory-prefabricated terminal module is fitted above the catwalk.

10. The system as claimed in claim 1, in which at least one catwalk that can be entered by operating personnel is provided along the painting booth, wherein the at least one factory-prefabricated terminal module is fitted underneath the catwalk.

11. The system as claimed in claim 10, wherein the catwalk has a window above the at least one factory-prefabricated terminal module.

12. The system as claimed in claim 1, wherein the operating mediums is a paint of a specific color or a purging liquid or air.

13. The system of claim 1, wherein each first terminal is located on a first side of the at least one factory-prefabricated terminal module and each second terminal is located on a second side of the at least one factory-prefabricated terminal module, wherein the second side is opposite the first side on the at least one factory-prefabricated terminal module.

* * * * *